US005497614A

United States Patent [19]

Duva

[11] Patent Number: 5,497,614

[45] Date of Patent: Mar. 12, 1996

[54] EXTERNAL COMBUSTION ENGINE HAVING AN ASYMMETRICAL CAM AND METHOD OF OPERATION

[75] Inventor: Anthony W. Duva, Newport, R.I.

[73] Assignee: The United States of America as represented by the Secretary of the Navy, Washington, D.C.

[21] Appl. No.: 348,688

[22] Filed: Nov. 30, 1994

[51] Int. Cl.[6] ..... F02G 3/02

[52] U.S. Cl. ..... 60/39.63; 91/499; 91/503

[58] Field of Search ..... 60/39.63; 91/499, 91/503; 123/43 AA, 56.2

[56] References Cited

U.S. PATENT DOCUMENTS

| | | | |
|---|---|---|---|
| 338,814 | 3/1886 | Wood | 91/503 |
| 646,024 | 3/1900 | Goodhart | 91/499 |
| 666,840 | 1/1901 | Arnold | 91/503 |
| 3,408,898 | 11/1968 | Hamlin | 91/503 |
| 5,253,473 | 10/1993 | Duva | 60/39.63 |

FOREIGN PATENT DOCUMENTS

| | | | |
|---|---|---|---|
| 647815 | 8/1928 | France | 123/56.2 |

*Primary Examiner*—Michael Koczo
*Attorney, Agent, or Firm*—Michael J. McGowan; Prithvi C. Lall; Michael F. Oglo

[57] ABSTRACT

An external combustion engine having an asymmetrical cam. The engine includes a combustion chamber for generating a high-pressure, energized gas from a monopropellant fuel and an even number of cylinders for sequentially receiving the energized gas through a rotary valve, the gas performing work on a piston disposed within each cylinder. The pistons transfer energy to a drive shaft through a connection to the asymmetrically shaped cam. The cam is shaped having two identical halves, each half having a power and an exhaust stroke. The identical halves provide that opposing cylinders are in thermodynamic balance, thus reducing rocking vibrations and torque pulsations. Having opposing pistons within the same thermodynamic cycle allows piston stroke to be reduced while maintaining displacement comparable to an engine having individual cycle positions. The reduced stroke diminishes gas flow velocity thus reducing flow induced noise. The power and exhaust strokes within each identical half of the cam are asymmetrical in that the power stroke is of greater duration than the exhaust stroke. The shape and length of the power stroke is optimized for increased efficiency.

17 Claims, 3 Drawing Sheets

EXTERNAL COMBUSTION ENGINE HAVING AN ASYMMETRICAL CAM AND METHOD OF OPERATION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention relates generally to external combustion expander-type engines. More particularly, the present invention relates to an external combustion expander-type engine having an asymmetrical shaped cam to convert piston linear reciprocating motion to shaft rotational motion.

2. Description of the Prior Art

It is known to propel a torpedo with a propulsion system which uses an external combustion expander-type engine in conjunction with a monopropellant fuel. The inventor of the present device, Duva, discloses such a system in U.S. Pat. No. 5,253,473. In this type of system, a solid initiator monopropellant fuel is combusted in the combustion chamber, producing a hot, energized gas which commences drive action of the torpedo and initiates the entry of a liquid, pressure-sensitive, sustainer monopropellant fuel into the combustion chamber through a poppet valve. Assuming that the pressure in the combustion chamber is sufficiently high, heat generated in the combustion of the initiator propellant effects combustion of the initial quantity of sustainer propellant which is admitted to the combustion chamber. Subsequently, combustion of the sustainer fuel continues in a self-sustaining manner due to the high temperature and pressure in the chamber, i.e. part of the energy generated in combustion of the sustainer propellant is used to combust additional sustainer propellant.

In a conventional external combustion engine, the pistons are parallel to the output drive shaft of the engine. The linear reciprocating motions of the pistons are converted to rotational motion of the drive shaft via a swashplate or a cam. The pistons derive their energy for axial motion from the high-energy gas expelled from the combustion chamber. Typically, the process occurs in a sequential manner for each cylinder and generates a reaction force parallel to the center line of the engine. The sequential nature of the reaction forces gives rise to rocking moments about the engine center line. In addition, the high-pressure gas is transferred to the cylinders through hot gas transfer channels. The high-pressure gas flowing through the channels generates flow noise proportional to the velocity and flow rate of the flowing gas. The combination of flow noise and noise generated by the rocking moment can be disadvantageous to the extent that such noise facilitates discovery of the location of the torpedo and the launching vessel.

SUMMARY OF THE INVENTION

Accordingly, it is a general purpose and object of the present invention to provide an external combustion expander-type engine having improved efficiency.

It is another object of the invention to provide an external combustion engine which generates less noise than a conventional external combustion engine.

Yet another object of the invention is to provide an external combustion engine which generates less mechanical rocking vibration than a conventional external combustion engine.

It is a further object of the invention to provide an external combustion engine which generates minimal torque pulsations during operation.

These objects are accomplished with the present invention by providing an external combustion expander-type engine having an asymmetrical cam for converting linear piston motion to shaft rotational motion. The external combustion engine of the invention comprises a combustion area for combusting a fuel to form an energized gas. The energized gas is then passed through a gas inlet port in a rotary valve which distributes energized gas to hot gas transfer channels connected to an even number of cylinders, each cylinder having a reciprocating piston disposed therein. The gas passing through the transfer channels is spent in moving the pistons linearly within their respective cylinders. The linear motions of the pistons are converted to a rotational motion of a drive shaft by the interaction of the pistons and an asymmetrical cam. The rotary valve is splined to the drive shaft such that the rotation of the shaft allows the rotary valve to rotate into position for the next engine cycle. The spent gas is removed from the cylinder through exhaust gas transfer channels, through an exhaust gas outlet channel in the rotary valve, and is transferred to an exhaust passage through which it is removed from the engine. The cam and splined valve are designed such that cylinders 180 degrees apart are always at the same position in the engine cycle.

The asymmetrical cam shape of the external combustion engine of the present invention allows for differing power and exhaust profiles. Efficiency may be increased by optimizing the cam shape to achieve a longer duration power stroke. The asymmetrical cam shape also reduces the output torque pulsations generated in the operation of a conventional external combustion expander-type engine. Output torque is spread over the longer duration of the power stroke. The asymmetry in the power and exhaust strokes allows for the kinematic addition of the peak power of one cylinder and the maximum negative power of another with resulting lower amplitude of the piston rate frequency and harmonics. The shape of the power stroke is also profiled to provide a lower power transmission angle between the piston rod roller and the cam during cylinder gas pressurization and an increased piston rod roller to cam transmission angle during cylinder gas expansion.

The cam shape is also divided into two symmetric halves to provide opposing pistons equal positions in the engine or thermodynamic cycle at all times. In providing symmetric thermodynamic cycle positions for opposing cylinders, the piston stroke can be reduced by a factor of two while maintaining comparable displacement to an engine having individual thermodynamic cycle positions for each cylinder. The reduced stroke provides a factor of two reduction in the hot gas flow velocity within the transfer channels, thus reducing the flow induced noise generated in the operation of the engine.

Further, the reaction forces generated by a piston against the cam are balanced by the opposing piston being in an equal position in the thermodynamic cycle. Rocking forces from one piston are canceled by the rocking forces of the opposing piston thereby reducing vibrations due to mechanical rocking.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
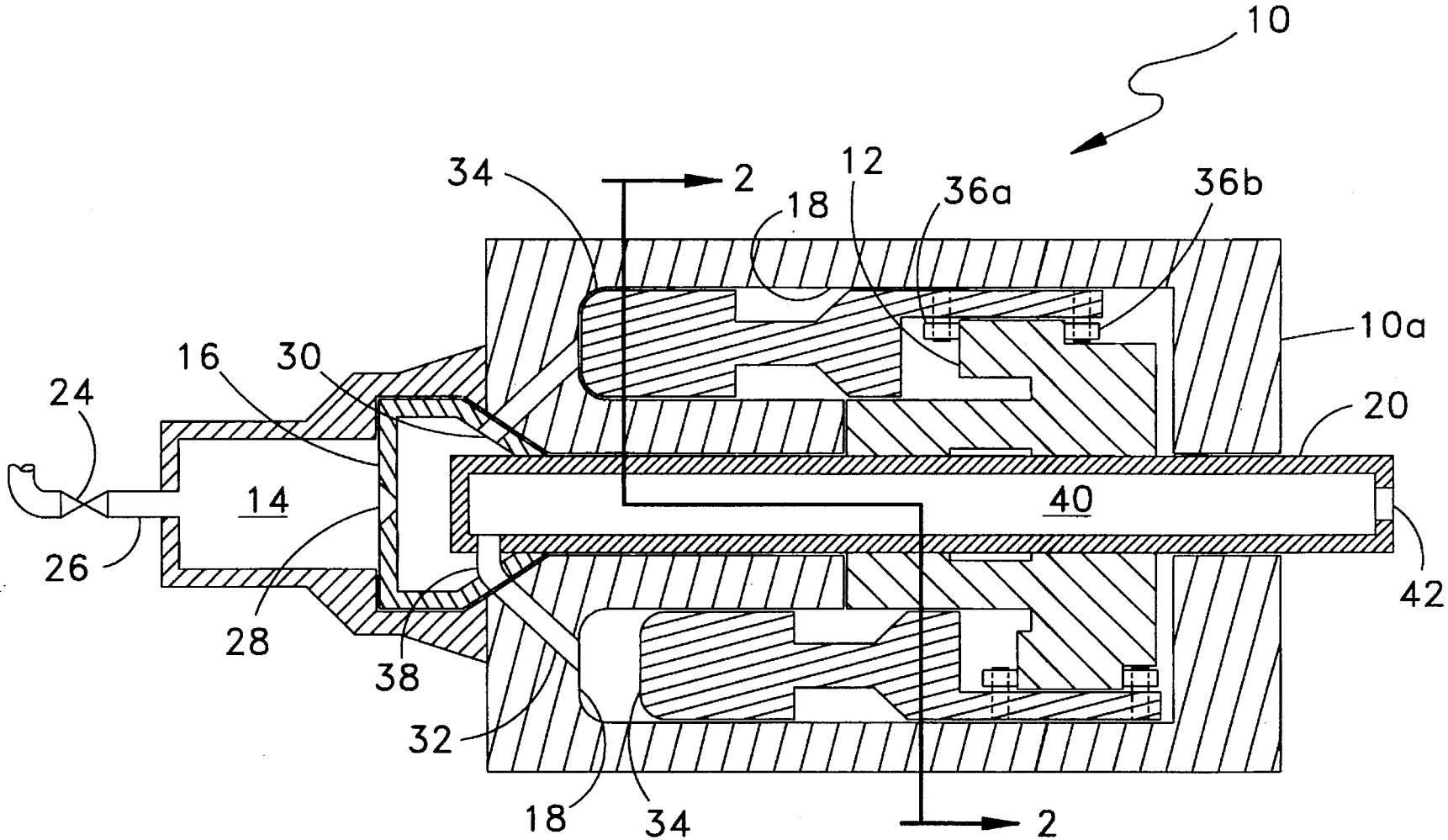
FIG. 1 is a longitudinal cross-sectional view of an external combustion engine having an asymmetrical cam in accordance with the present invention, the section 1—1 of FIG. 2.

Referring now to FIG. 1, there is shown an external combustion engine 10 having an asymmetrical cam 12 according to the present invention. Engine 10 is of the type having a cylindrical combustion chamber 14 for generating a high-pressure, energized combustion gas from a monopropellant fuel. The energized gas is passed from combustion chamber 14 through a conventional rotary valve 16 to an even number of cylinders 18, two of which are shown in FIG. 1. Cylinders 18 are arranged symmetrically around a central drive shaft 20. Drive shaft 20 is coaxial with, and splined to, rotary valve 16. The energized gas is spent in cylinders 18 in order to rotate drive shaft 20. It is to be appreciated that with the exception of certain improvements to the engine as described herein, including the asymmetrical cam 12, the operation and construction of engine 10 is conventional and known.

Engine 10 operates in the following manner. Prior to starting engine 10, combustion chamber 14 contains a solid initiator propellant (not shown) which is ignited when engine 10 is first started. As the initiator propellant combusts, it generates a hot, energized gas which commences drive action of engine 10 and opens a poppet valve 24 at fuel inlet port 26 to combustion chamber 14 to admit a liquid sustainer propellant into combustion chamber 14. The sustainer propellant, which is a monopropellant fuel, such as OTTO Fuel II, is pumped by a pump (not shown) through fuel inlet port 26 into combustion chamber 14. The heat generated by combustion of the initiator propellant commences combustion of the sustainer propellant to form a hot, high-pressure, energized gas. Commonly, the operating pressure in combustion chamber 14 is on the order of 800 to 1000 p.s.i. As a portion of the energized gas in combustion chamber 14 is removed from combustion chamber 14 in a conventional manner, additional sustainer propellant is pumped into combustion chamber 14 and is combusted due to the high temperature and pressure in combustion chamber 14. Energized gas is removed from combustion chamber 14 through energized gas inlet port 28 in rotary valve 16. The energized gas is distributed to cylinders 18 via energized gas channels 30 to inlet 32 of each cylinder. Inlets 32 are positioned around rotary valve 16 for sequential registry with channels 30 in a known manner as the rotary valve rotates. Rotary valve 16 comprises two energized gas channels 30 spaced 180° degrees apart such that energized gas is distributed sequentially to opposing cylinders.

Figure 2:
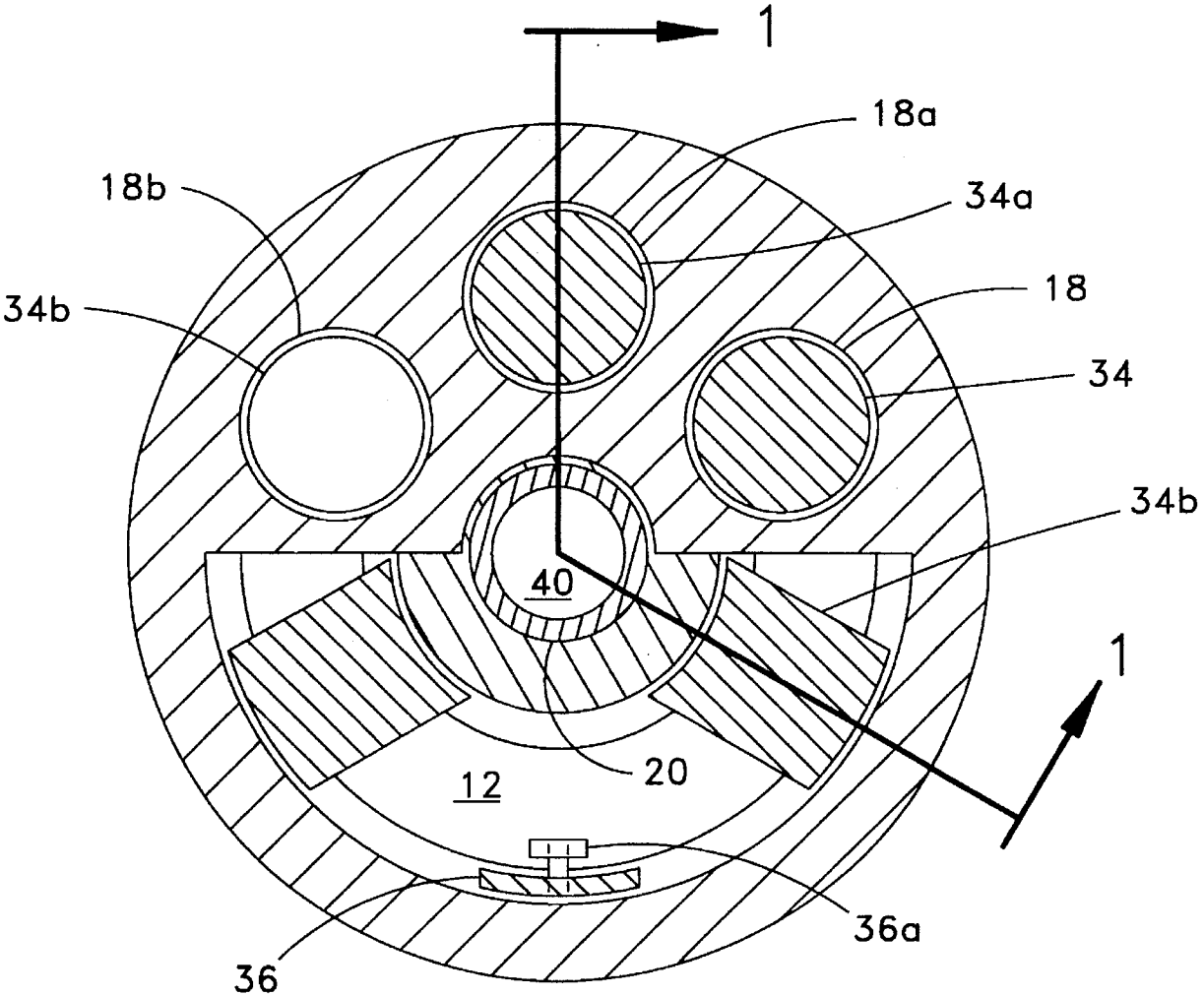
FIG. 2 is a transverse cross-section of the external combustion engine of FIG. 1, taken at 2—2 of FIG. 1.

Referring additionally to FIG. 2, each cylinder 18 contains a reciprocating piston 34. Roller end 36 of piston 34 extends outside cylinder 18. Roller end 36 has forward and aft rollers **36*a* and 36*b*, respectively, abutting opposite faces of rotating asymmetrical cam 12. Asymmetrical cam 12 is rigidly affixed to shaft 20. Opposing cylinders 18 receiving the energized gas and their corresponding pistons 34 are referred to hereafter as active cylinders 18*a* and active pistons 34*a*, respectively. The energized gas entering active cylinders 18*a* through inlet 32 moves both active pistons 34*a* identically and linearly away from inlet 32 and towards aft end 10*a* of engine 10. Forward roller 36*a* pushes against asymmetrical cam 12 causing cam 12 and affixed shaft 20** to rotate.

Figure 3:
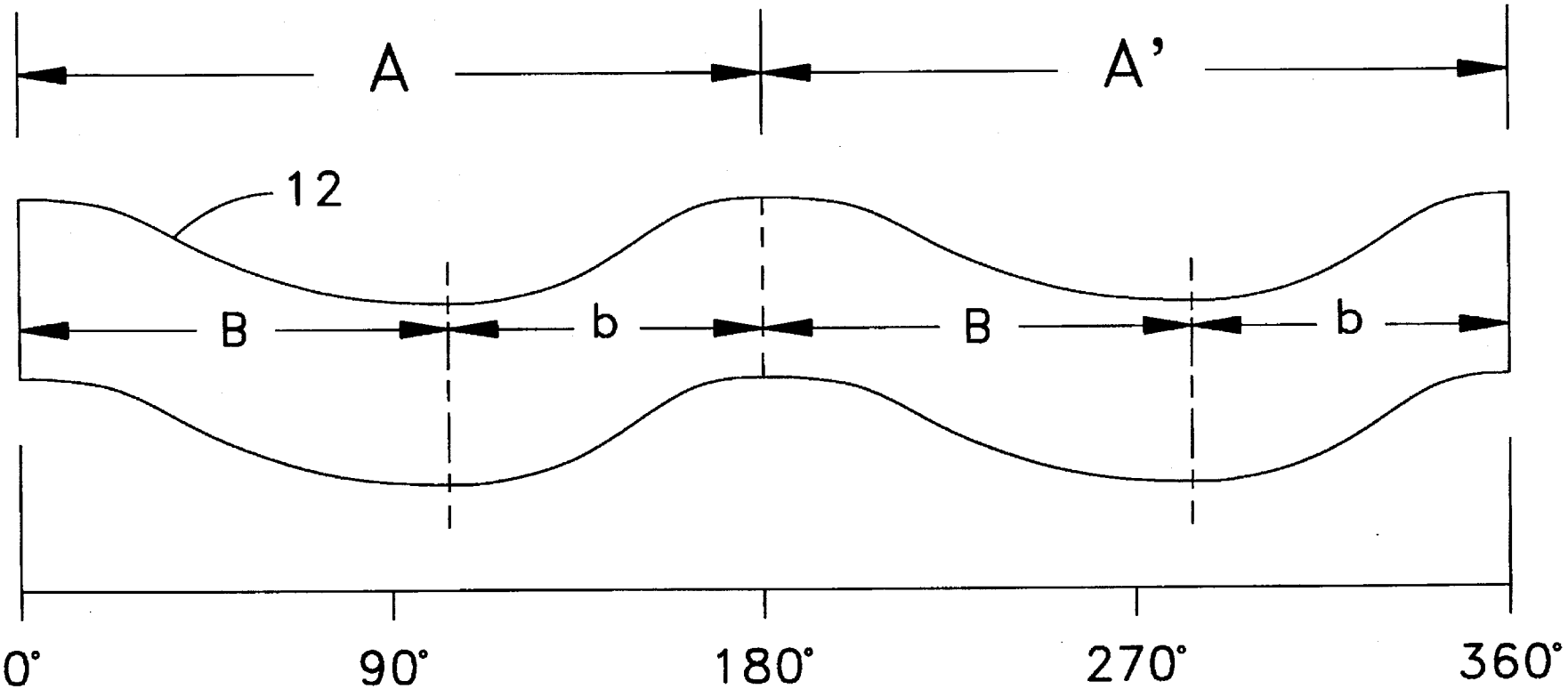
FIG. 3 is a developed view of the asymmetrical cam of the engine of FIG. 1.

Referring additionally to FIG. 3, asymmetrical cam 12 is shown in a developed view. Cam 12 shape is shown to have two identical halves, designated A and A'. Each half includes a power stroke section designated B, and an exhaust stroke section designated b. In the preferred embodiment, power strokes B encompass angles greater than 90 degrees and exhaust strokes b encompass angles complementary to that encompassed by power strokes B, thus making each half A and A' asymmetrical.

The rotation of cam 12 further causes diametrically opposed inactive pistons **34*b*, which are within the exhaust stroke cycle, to move identically linearly away from the aft end 10*a* of engine 10, forcing spent gas back through inlet 32 in a known manner. In the exhaust stroke, inlets 32 of inactive pistons 34*b* are aligned with exhaust gas outlet port 38 in rotary valve 16. Spent gas is introduced into exhaust gas outlet port 38 and is subsequently transferred to elongated exhaust duct 40 located within drive shaft 20. The exhaust gas is then emitted from engine 10 into the surrounding medium at the outer end 42 of exhaust duct 40. A preferred embodiment incorporates appropriate seals (not shown in FIGS. 1–3) between cylinders 18 and pistons 34 and surrounding gas channel 30 and outlet port 38**.

Asymmetrical cam 12 preferably is custom-designed for use under particular process conditions. The optimum design of asymmetrical cam 12 will depend upon the anticipated use of engine 10, and also will depend upon temperature and pressure conditions in combustion chamber 14, the flow rate of the energized gas, and the type of sustainer monopropellant fuel to be used. For a particular application, asymmetrical cam 12 is best designed using a combination of fluid flow equations and empirical data with the general timing of FIG. 3. The degree of asymmetry can be varied to obtain the desired output characteristics.

In light of the above, it is therefore to be understood that within the scope of the appended claims, the invention may be practiced otherwise than as specifically described.

What is claimed is:

1. An external combustion expander-type engine comprising:

a combustion area for combusting a monopropellant fuel to form an energized gas;

a minimum of two cylinders fluidly connected to the combustion area, each of said minimum of two cylinders having a piston disposed therein, the energized gas being spent in the cylinders to move the pistons;

an asymmetrical cam in contact with the pistons and affixed to a drive shaft, the movement of the pistons causing the rotation of the asymmetrical cam and the drive shaft, the asymmetrical cam having at least one power stroke and at least one exhaust stroke, said at least one power stroke being of greater duration than said at least one exhaust stroke;

an exhaust passage for removing spent gas from the engine; and a rotary valve for transferring the energized gas from the combustion area to the cylinders and for transferring the spent gas from the cylinders to the exhaust passage.

2. An engine according to claim 1 wherein the engine comprises at least two pairs of cylinders, one cylinder of each of said pairs of cylinders having an active piston therein and one cylinder of each of said pairs of cylinders having an inactive piston therein, said energized gas flowing into said cylinders having an active piston therein.

3. An engine according to claim 2 wherein:

the drive shaft is coaxial with the cam;

the cylinders are disposed symmetrically in a radial fashion about said shaft, said cylinders having an active piston therein alternating with said cylinders having an inactive piston therein, such that an active piston of a first pair of cylinders is diametrically opposed to an active piston of a second pair of cylinders; and the motion of the pistons is parallel to the drive shaft.

4. An engine according to claim 3 wherein the asymmetrical cam comprises an even number of identical power strokes and a corresponding even number of identical exhaust strokes, said even number of power strokes being spaced symmetrically about said coaxial axis of said asymmetrical cam such that diametrically opposed active pistons are acting on identical portions of the power strokes and diametrically opposed inactive pistons are acting on identical portions of the exhaust strokes of said asymmetrical cam.

5. An engine according to claim 4 wherein the rotary valve is affixed coaxially to the drive shaft.

6. An engine according to claim 5 wherein the rotary valve further comprises:

an energized gas passage for fluidly and sequentially connecting the combustion chamber to the cylinders of said diametrically opposed active pistons, the energized gas causing the movement of the active piston against the cam; and an exhaust port for fluidly and sequentially connecting cylinders of diametrically opposed inactive pistons to said exhaust passage, the rotation of the cam causing inactive piston movement expelling the spent gas from the cylinders.

7. An engine according to claim 6 wherein said exhaust passage passes within said drive shaft.

8. An engine according to claim 1 wherein:

the drive shaft is coaxial with the cam;

said engine comprises at least two pairs of diametrically opposed cylinders, said pairs of cylinders being disposed symmetrically about said shaft; and the motion of the pistons is parallel to the drive shaft.

9. An engine according to claim 8 wherein the rotary valve is affixed coaxially to the drive shaft.

10. An engine according to claim 9 wherein the rotary valve further comprises:

an energized gas passage for fluidly and sequentially connecting the combustion chamber to cylinders of the diametrically opposed pistons, the energized gas causing the movement of the pistons against the cam; and an exhaust port for fluidly and sequentially connecting cylinders of diametrically opposed pistons to said exhaust passage, the rotation of the cam causing piston movement expelling the spent gas from the cylinders.

11. An engine according to claim 10 wherein said exhaust passage passes within said drive shaft.

12. An engine according to claim 1 wherein the rotary valve is affixed coaxially to the drive shaft.

13. An engine according to claim 12 wherein the rotary valve further comprises:

an energized gas passage for fluidly and sequentially connecting the combustion chamber to the cylinders, the energized gas causing the movement of the piston against the cam; and an exhaust port for fluidly and sequentially connecting cylinders to said exhaust passage, the rotation of the cam causing piston movement expelling the spent gas from the cylinders.

14. An engine according to claim 13 wherein said exhaust passage passes within said drive shaft.

15. A method for improving efficiency of an external combustion expander-type engine comprising a combustion area for combusting a monopropellant fuel to form an energized gas, at least one cylinder fluidly connected to the combustion area, the cylinder having a piston disposed therein, the energized gas being spent in the cylinder to move the piston, an asymmetrical cam in contact with the piston and affixed to a drive shaft, the movement of the piston causing the rotation of the drive shaft, the asymmetrical cam having a power stroke for transferring the movement of the piston to the rotation of the drive shaft and having an exhaust stroke for expelling the spent gas from the cylinder, the method comprising:

shaping the asymmetrical cam to have the power stroke of greater duration than the exhaust stroke, said greater duration power stroke providing increased rotation of the drive shaft during a power stroke, said increased rotation corresponding to an increase in efficiency measured by the amount of shaft rotation per power stroke.

16. A method for reducing energized gas flow noise in an external combustion expander-type engine comprising a combustion area for combusting a monopropellant fuel to form the energized gas, at least two cylinders fluidly connected to the combustion area, each of the cylinders having a piston disposed therein, the energized gas being spent in the cylinders to move the pistons, an asymmetrical cam in contact with the pistons and affixed to a drive shaft, the movement of the pistons causing the rotation of the drive shaft, the asymmetrical cam having a number of power strokes corresponding to the cylinders fluidly connected to the combustion chamber, said power strokes for transferring the movement of the pistons to the rotation of the drive shaft, the asymmetrical cam having a corresponding number of exhaust strokes for expelling the spent gas from the cylinder, the power strokes being of greater duration than the exhaust strokes, and a rotary valve for transferring the energized gas from the combustion area to the cylinders, the method comprising:

transferring a full amount of energized gas from the combustion area to at least two cylinders simultaneously, each cylinder receiving equal portions of the full amount of energized gas, the energized gas flow noise corresponding to the portion of energized gas entering a cylinder over a period of time being less than the energized gas flow noise corresponding to the full amount of energized gas entering one cylinder over said time period.

17. A method for reducing torque pulsations in an external combustion expander-type engine comprising a combustion area for combusting a monopropellant fuel to form an energized gas, at least two cylinders, each cylinder having a piston disposed therein, a first one of the cylinders being fluidly connected to the combustion area, the energized gas being spent in the first one of the cylinders to move an active piston therein, an asymmetrical cam in contact with the active piston and affixed to a drive shaft, the movement of the active piston causing the rotation of the drive shaft, the asymmetrical cam having a power stroke for transferring the movement of the active piston to the rotation of the drive shaft and having an exhaust stroke for expelling the spent gas from the cylinder, an inactive piston in a second one of the cylinders, the inactive piston being within the exhaust stroke of the asymmetrical cam, the method comprising:

shaping the asymmetrical cam such that a kinematic addition of a first driving force resulting from the active piston movement against the asymmetrical cam and a second driving force resulting from the asymmetrical cam movement against the inactive piston provides a smooth output torque over the rotation of the drive shaft through a cycle of one power stroke and one exhaust stroke of the asymmetrical cam.

* * * * *